United States Patent [19]

Frano

[11] Patent Number: 4,976,017

[45] Date of Patent: Dec. 11, 1990

[54] ADJUSTABLE WAISTBAND ASSEMBLY

[75] Inventor: Frank Frano, Hoffman Estates, Ill.

[73] Assignee: Illinois Tool Works, Inc., Chicago, Ill.

[21] Appl. No.: 194,433

[22] Filed: May 12, 1988

[51] Int. Cl.[5] ..... A44B 11/25
[52] U.S. Cl. ..... 24/585; 24/580
[58] Field of Search ..... 24/580, 581, 584, 585, 24/68 R, 68 J, 68 SK

[56] References Cited

U.S. PATENT DOCUMENTS

| | | | |
|---|---|---|---|
| 1,213,109 | 1/1917 | Kilstrom | 24/585 |
| 1,344,816 | 6/1920 | Passage | 24/585 |
| 3,956,802 | 5/1976 | Kanzaka | 24/585 |
| 4,674,158 | 6/1987 | Lau | 24/580 |

FOREIGN PATENT DOCUMENTS

| | | | |
|---|---|---|---|
| 2454363 | 5/1975 | Fed. Rep. of Germany | 24/585 |
| 2408018 | 8/1975 | Fed. Rep. of Germany | 24/585 |

*Primary Examiner*—James R. Brittain
*Attorney, Agent, or Firm*—Schwarzt & Weinrieb

[57] ABSTRACT

A two-piece adjustable waistband assembly includes a track member and a latch member. The track member is sewable to the underlying part of a waistband, and the latch member is sewable to the overlying part of the waistband and is adapted for receiving the track member. The latch member is formed with a pawl which is resiliently biased into rectangularly-shaped slots formed within the track member, thereby detachably interengaging the latch member with the track member. The latch member may be lifted at its one end so as to cause disengagement of the pawl from the recesses so as to permit movement of the latch member along the length of the track member.

20 Claims, 2 Drawing Sheets

ADJUSTABLE WAISTBAND ASSEMBLY

BACKGROUND OF THE INVENTION

1. Field of the Invention:

This invention relates generally to fastener devices for waistbands or the like provided upon garments such as trousers, skirts or the like. More particularly, it relates to a two-piece adjustable waistband assembly having a sewable track member which is attached to one part of the waistband and a sewable latch member which is attached to the other part of the waistband. The sewable latch member has a pawl member or detent which is resiliently biased into recesses formed within the track member, thereby detachably interengaging the latch member with the track member.

2. Description of the Prior Art:

In U.S. Pat. No. 462,779 issued to John H. Smith on Nov. 10, 1891, there is disclosed a shoe buckle which comprises of a slotted tongue section and a keeper section. The keeper section has flanged guides formed upon its side edge portions and a plurality of slots formed within an axially central portion thereof. The slotted tongue section is formed with an elongated opening and has secured in a cantilevered manner such that a flat spring free end of the spring, which is provided with a catch, can pass through the elongated opening so as to engage with the slots formed within the keeper section.

In U.S. Pat. No. 2,138,542 issued to Isidore Goldberg on Nov. 29, 1938, there is disclosed a buckle which consists of (1) a female member having longitudinally extending, laterally spaced channeled sections with a plurality of longitudinally spaced catches defined within the sections and (2) a male member slidable within the channeled sections of the female member. A shaft is journalled within the male member, and spaced dogs are fixed upon the shaft adjacent the ends thereof for engagement with the spaced catches. A coil spring is provided upon the shaft for maintaining the dogs in engagement with a pair of the spaced catches so as to prevent movement of the male member relative to the female member in one direction and permit movement thereof in the opposite direction. A finger piece is fixed upon the shaft between the dogs and extends between the channeled sections for releasing the dogs from the spaced catches so as to permit withdrawal of the male member from the channeled sections of the female member.

In U.S. Pat. No. 3,267,545 to C. M. Eckart issued on Aug. 23, 1966, there is described an overshoe buckle which includes a strip-like latchable element having notches defined therein and a tubular latch structure for receiving the latchable element. A detent is provided upon the exterior edge of each one of two opposite side walls of the tubular structure, and a slot is formed within the top wall of the tubular structure. A leaf spring is attached at one end to the exterior of the top wall of the tubular structure and has a bent portion defining a catch at its other end. The catch extends through the slot of the tubular structure top wall and projects into the interior of the tubular structure so as to engage the notches upon the latchable element. A substantially U-shaped lift is provided so as to enable the manual raising of the catch from engagement with the notches so as to permit withdrawal of the latchable element from the tubular structure. The raising action is limited by engagement of flanges formed upon side edge portions of the lift against underside portions of the detents.

In U.S. Pat. No. 4,545,096 to Belter et al. issued on Oct. 8, 1985, there is described a fastener for waistbands or the like which includes a detent adjustment rail fastened to one part of the waistband and a slide displaceable upon the rail. The slide carries a pivotal lever which extends beyond its pivot so as to form a detent projection. The detent projection cooperates with detent depressions formed upon the adjustment rail for locking the slide at a desired position upon the rail. The slide or lever is detachably connectible to the other part of the waistband. The other waistband part is provided upon its inside surface with a hook which is engagable with an opening defined within either the slide or lever.

However, none of the prior art discussed above disclose an adjustable waistband assembly like that of the present invention which provides a two-piece adjustable waistband assembly for use upon a garment waistband having an underlying part and an overlying part which consists of a track member and a latch member. The track member is sewable to the underlying part of the waistband, and the latch member is sewable to the overlying part of the waistband and is adapted for receiving the track member. The track member is formed with a plurality of rectangularly-shaped recesses. The latch member is formed so as to have a substantially rectangular configuration and has a pawl for detachable interengagement with the recesses, the pawl being resiliently biased into such recesses. The latch member is lifted so as to cause disengagement of the pawl from the recesses.

OBJECTS OF THE INVENTION

Accordingly, it is a general object of the present invention to provide a two-piece adjustable waistband assembly which is relatively simple in its construction and has reduced costs in manufacturing and assembling.

It is an object of the present invention to provide a two-piece adjustable waistband assembly which includes a track member which is sewed to one part of a garment waistband and a latch member which is sewable to another part of the garment waistband.

It is another object of the present invention to provide a two-piece adjustable waistband assembly which includes a sewable latch member having a pawl which is resiliently biased into recesses formed within a track member, thereby detachably interengaging the latch member with the track member.

It is still another object of the present invention to provide a two-piece adjustable fastener assembly which comprises of a track member and a latch member in which both members are made of a resilient plastic material.

SUMMARY OF THE INVENTION

In accordance with these aims and objectives, the present invention is concerned with the provision of a two-piece adjustable fastener assembly for use upon a garment waistband having an underlying part and an overlying part. The fastener assembly includes a track member which is sewable to the underlying part of the waistband and a latch member which is sewable to the overlying part of the waistband. The latch member is further adapted to receive the track member. The track member is formed with a plurality of rectangularly-shaped recesses. The latch member has a substantially rectangular configuration and includes a pawl for detachable engagement with the recesses. The pawl is resiliently biased into the recesses so as to prevent separation of the latch member from the track member. The latch member is lifted so as to permit disengagement of the pawl from the recesses.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the several views, wherein.

DESCRIPTION OF THE PREFERRED EMBODIMENTS

Figures 1, 2, 2A, 3, 4, 5, 6:
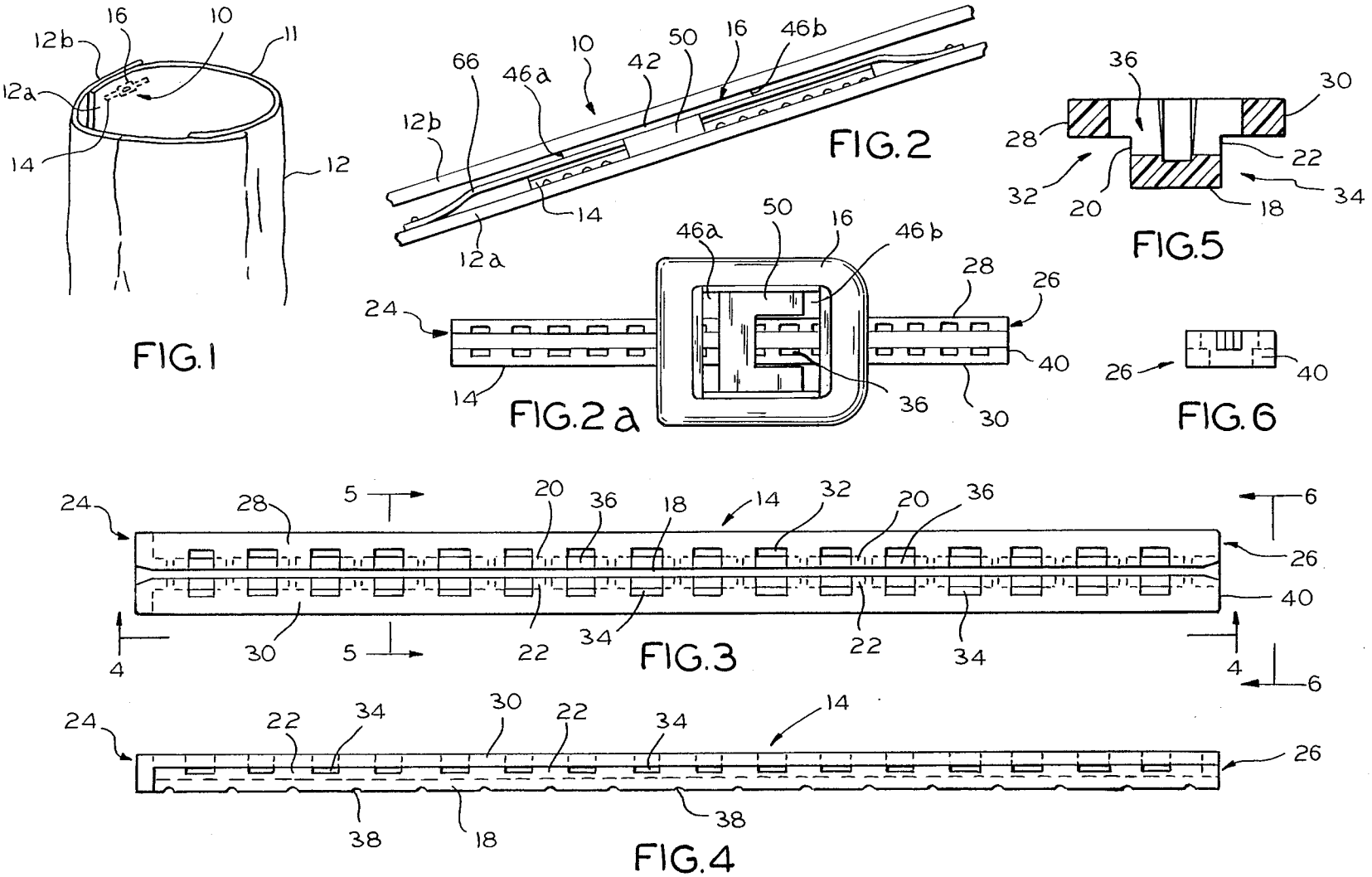
FIG. 1 shows an adjustable waistband assembly constructed in accordance with the principles of the present invention, as applied to a trouser waistband.
FIG. 2 and 2*a* show enlarged views of the adjustable waistband assembly of the present invention, with the latch member detachably interengaged with the track member.
FIG. 3 is a plan view of the track member.
FIG. 4 is an elevational view of the track member, taken along the lines 4—4 of FIG. 3.
FIG. 5 is a cross-sectional view of the track member, taken along the lines 5—5 of FIG. 3.
FIG. 6 is an end view of the track member, taken along the lines 6—6 of FIG. 3.

Referring now in detail to the various views of the drawings, there is shown in FIG. 1 a two-piece adjustable fastener or waistband assembly 10 of the present invention which is applied to a garment, such as a pair of trousers 12, in order to effect a ready adjustment in the waist dimension for accommodating the body of a wearer. The waistband assembly 10 is comprised of a track member 14 which is attached to an underlying part 12*a* of the trouser waistband 11 and a latch member 16 which is attached to an overlying part 12*b* of the trouser waistband 11. The track member 14 may be suitably sewed so as to be fixedly attached to the underlying part 12*a* of the waistband 11. The latch member 16 likewise may be suitably sewed so as to be fixedly attached to the overlying part 12*b* of the waistband. The latch member 16 is adapted for receiving the track member which is pushed into detachable interengagement with the latch member, whereby the latch member is releasably locked or latched at various positions along the track member.

In FIGS. 3–6 of the drawings, there are illustrated in the various views the details of the construction of the track member 14 of the waistband assembly 10. The track member 14 is formed of a central horizontal web portion 18 and spaced apart vertical side wall segments 20 and 22 disposed upon opposite sides of the web portion 18 and extending between the ends 24, 26 thereof. At the upper ends of the side wall segments 20 and 22, there are provided outwardly extending flanges 28, 30 which are disposed perpendicularly to their respective side walls 20, 22. Between the adjacent side wall segments 20 directly above the web portion within its one side, there are formed a series of openings 32. Similarly, there are formed a series of openings 34 between the adjacent side wall segments 22 within the other side of the web. Each of the openings 34 of the one side are arranged in alignment with the respective openings 32 on the opposite side so as to form a plurality of substantially rectangularly-shaped slots or recesses 36.

As can best be seen from FIG. 4, the lower outer surface of the web portion 18 is formed with U-shaped cutouts 38 so as to provide flexibility in the track member 14. In FIG. 6, a stop member 40 is disposed at the right end 26 of the web portion 18 for a purpose to be presently explained. The track member 14 may be formed of a high or low density polyethylene, polypropylene, or other resilient plastic material and can be fabricated by means of insert injection molding techniques as a single-piece. The web portion 18 is designed to be thin enough so as to be sewed to the underlying part 12*a* of the waistband 11. Alternatively, the web portion 18 may be provided with pin holes (not shown) so as to facilitate sewing. Furthermore, the track member 14 is designed to be flexible enough so as to be bendable about the waist of the wearer during use.

Figure 7:
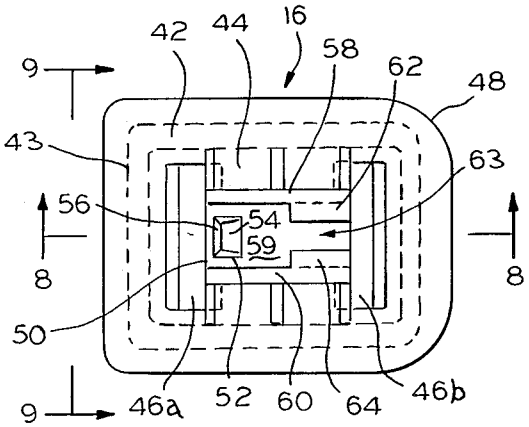
FIG. 7 is a plan view of the latch member.
Figure 8:
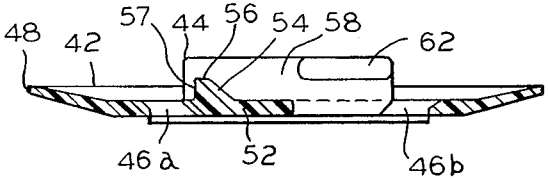
FIG. 8 is a cross-sectional view of the latch member, taken along the line 8—8 of FIG. 7.
Figure 9:
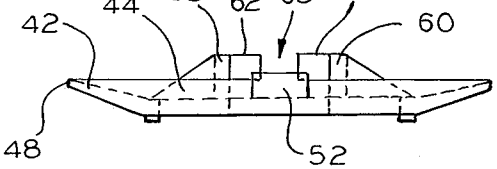
FIG. 9 is an end elevational view of the latch member, taken along the line 9—9 of FIG. 7.

In FIGS. 7–9 of the drawings, there are illustrated in the various views the details of the construction of the latch member 16 of the fastener assembly 10. The latch member 16 has a substantially rectangular configuration having an outer rim portion 42 and an intermediate portion 44 disposed centrally within the rim portion 42 so as to define elongated slots 46*a*, 46*b* therebetween. The outer rim portion 42 is made so as to be sloped downwardly from its outer edge 48 towards the intermediate portion 44. Likewise, the latch member 16 may be formed of a high or low density polyethylene, polypropylene, or other resilient plastic material and can be fabricated by means of insert injection molding techniques as a single-piece. The outer rim portion 42 is designed to be thin enough so that it can be sewed along the dotted line 43 onto the inside surface of the overlying part 12*b* of the trouser waistband 11.

The intermediate portion 44 is comprised of a C-shaped base section 50 which is located between two sides of the outer rim portion 42 so as to form the elongated slots 46*a*, 46*b* therebetween. The base section 50 includes a pawl 52 having an inclined surface 54, a flat top surface 56 and a vertical surface 57. The pawl 52 is formed upon the surface of a flat member 59 of the base section 50. A pair of vertical wall members 58, 60 are integrally formed upon the flat member 59 upon opposite sides of the pawl 52 and extend longitudinally between the elongated slots 46*a*, 46*b*. At the uppermost extremities of the respective wall members 58, 60 adjacent the elongated slot 46*b*, there are provided corresponding depending or inwardly extending support legs 62, 64 which are spaced opposite each other so as to form an aperture 63 therebetween for purposes to be described hereinafter.

As can be seen from FIG. 2, the elongated slots 46*a*, 46*b* serve as a means for attaching the latch member 16 to a garment cover strip 66. The ends of the cover strip 66 are sewn to be underlying part 12*a* of the waistband adjacent the ends of the track member 14 so as to cover or conceal the track member. The track member 14 is slidable into the latch member 16, and the latch member is movable along the length of the track member 14 with the vertical wall members 58, 60 and the depending support legs 62, 64 serving as a guide to enable the flanges 28, 30 of the track member to slide along the surfaces of the vertical walls and depending legs. The web portion 18 is passed through the aperture 63 formed by means of the depending legs as the latch member is moved along the length of the track member.

As is depicted in FIG. 2*a*, the latch member 16 may be moved towards the right end of the track member 14 by pushing the latch member towards the right so as to cause the flanges 28, 30 to slide up the inclined surface 54 and have the pawl 52 of the latch member 16 sequentially engage with the recesses 36 defined within the track member 14, thereby detachably interengaging the latch member with the track member. It should be noted that the left end of the outer rim portion 42 adjacent the elongated slot 46*a* functions to provide a spring bias to exert a downward force causing the pawl 52 to be retained within one of the rectangularly-shaped recesses 36 and the vertical surface 57 of the pawl prevents movement of the latch member back toward the left end of the track member. Thus, the latch member 16 may in this way be adjusted to a desired latched position along the length of the track member 14. The movement of the latch member toward the right end of the track member is limited as a result of engagement of the stop member 40 against the outer surfaces of the legs 62, 64.

In order to move the latch member 16 towards the left end 24 of the track member 14, it is necessary to manually raise the left end of the latch member 16 in an upward direction which causes the latch member to pivot within the track member 14 about the legs 62,64 in a direction opposite the biasing direction whereby pawl 52 is engaged within a selective one of the recesses 36 so as to cause disengagement of the pawl 52 from the recess 36. As a result, the latch member 16 may now be held by means of one's fingers so as to slide the same along the flanges 28, 30 towards the left end 24 of the track member. When the left end of the latch member 16 is released, the pawl 52 will again become engaged with one of the recesses 36 so as to provide a latched position because of the resiliency or spring bias of the outer rim portion 42.

Figure 11:
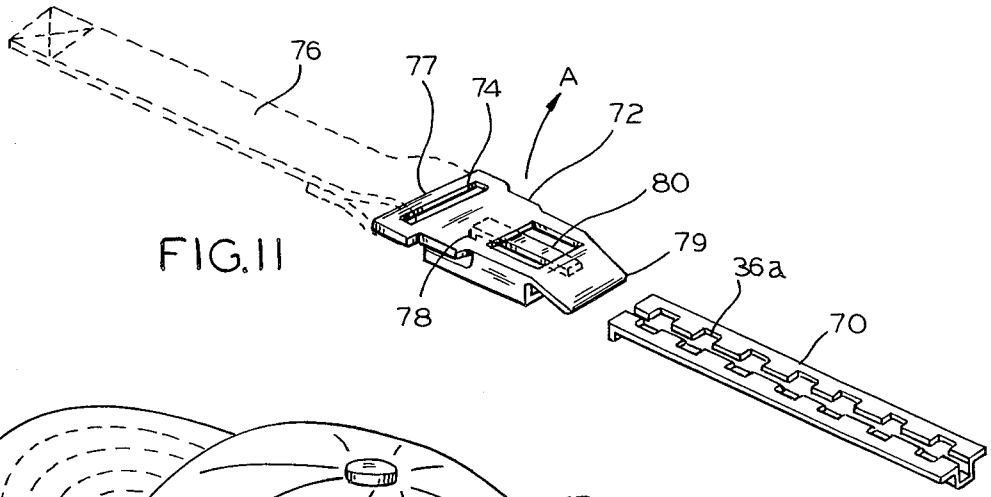
FIG. 11 is an exploded view of the adjustable cap band assembly of FIG. 10, with the track member being separated from the latch member.
Figure 10:
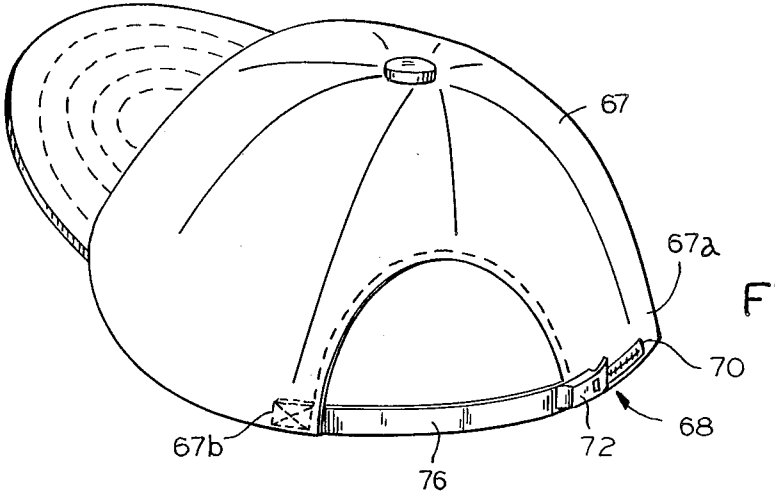
FIG. 10 shows an adjustable cap band assembly constructed as a second embodiment of the present invention.

In FIGS. 10 and 11 of the drawings, there are shown a second embodiment of the present invention which is applied to a cap 67 and consists of a two-piece adjustable cap band assembly 68. The adjustable cap band assembly 68 is comprised of a track member 70 and a latch member 72. The track member is attached to a part 67*a* of the cap 67 by sewing or any other well-known means and is identical in construction to the track member 14 previously described. Thus, the details of the track member 70 will not be repeated.

The latch member 72 is provided with an elongated slot 74 for receiving and/or attachment to one end of a strap 76. The other end of the strap 76 may be sewed to a part 67*b* of the cap. The latch member 72 has a generally rectangular configuration having a first end 77 and a second end 79. The latch member 72 includes a pawl 78 formed adjacent its first end 77 which is engageable with one of the slots 36*a* defined within the track member 70. A single leg member 80 is formed integrally with the pawl 78 and extends longitudinally towards the second end 79 of the latch member. The first end 77 of the latch member 72 provides a spring bias so as to exert a downward force causing the pawl 78 to be retained within one of the slots 36*a* and to prevent disengagement of the latch member 72 from the track member 70 as was described with respect to the first embodiment.

In order to disengage the pawl 78 from the slot 36*a* so as to permit movement of the latch member along the track member, it is necessary to manually lift the left end 77 of the latch member 72 in the direction of the arrow A and then slide the same along the flanges of the track member.

Figure 12:
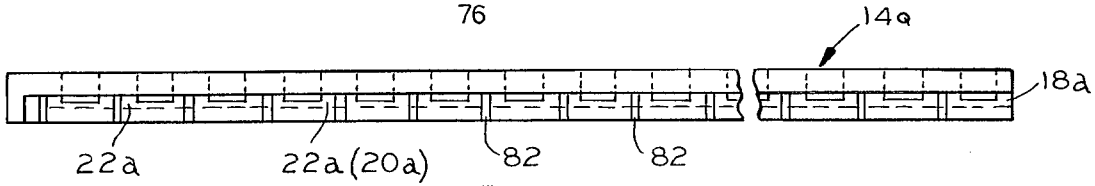
FIG. 12 is a side elevational view of a second embodiment of a track member, constructed in accordance with the present invention.

In FIG. 12, there is illustrated a second embodiment of a track member 14*a*of the present invention. The track member 14*a* is substantially identical to the track member 14 of FIG. 4, except that the U-shaped cut-outs 38 have been replaced with apertures 82 formed within the central horizontal web portion 18*a* between the spaced apart side wall segments 20*a*, 22*a* disposed upon the opposite sides of the web portion. These apertures 82 serve to provide a greater resiliency or flexibility so as to facilitate bending of the track member 14*a* during use, thereby rendering an easier and smoother operation of the adjustment assembly.

From the foregoing detailed description, it can thus be seen that the present invention provides a two-piece adjustable fastener assembly for use upon a garment band which consists of a sewable track member attached to one part of the garment band and a sewable latch member attached to the other part of the garment band. Furthermore, the latch member is provided with a pawl which is resiliently biased into slots formed within the track member, thereby detachably interengaging the latch member with the track member. The track member and latch member may both be formed of a resilient plastic material so as to facilitate manufacture and assembly.

While there has been illustrated and described what is at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out the invention, but that the invention will include all embodiments falling within the scope of the appended claims.

What is claimed is:

1. A two-piece adjustable fastener assembly for use upon a clothing article band having an underlying part and an overlying part, comprising:

a track member, having a plurality of recesses formed therein, being securable to said underlying part of said clothing article band; and a latch member, being securable to said overlying part of said article band and adjustably engageable with said track member so as to define therewith said two-piece adjustable fastener, and including first means for engaging an undersurface portion of said track member; pawl means for selectively engaging any one of said plurality of recesses formed within said track member so as to provide adjustable positional movement and engagement of said latch member and said overlying part of said article band with respect to said track member and said underlying part of said article band; and second means, integrally interconnecting said first means and said pawl means such that said first means, said pawl means and said second means form a one-piece latch member, for engaging an upper surface portion of said track member so as to cooperate with said first means engaging said undersurface portion of said track member whereby said second means is resiliently deformably moved in a first direction away from said first means so as to cause said latch member to be resiliently, yet releasably, biased for movement in a second direction, opposite to said first direction of said second means, toward said first means and into engagement with said any one of said plurality of recesses formed within said track member.

2. A fastener assembly as claimed in claim 1, wherein:

said track member is formed of a central horizontal web portion and spaced apart vertical side wall segments disposed upon opposite sides of said web portion and extending between the ends thereof, said side wall segments having their upper ends formed with outwardly extending flanges which are disposed perpendicular to the respective side wall segments, the side wall segments having openings defined therein which are in alignment with respect to each other so as to define said plurality of recesses.

3. A fastener assembly as claimed in claim 2, wherein said horizontal web portion has its lower outer surface formed with U-shaped cut-outs arranged beneath the spaced apart wall segments disposed on the opposite sides of the web portion.

4. A fastener assembly as claimed in claim 3, wherein said track member is made of a resilient plastic material.

5. A fastener assembly as claimed in claim 2, wherein said horizontal web portion has apertures which are provided between the spaced apart wall segments disposed on the opposite sides of the web portion.

6. A fastener assembly as claimed in claim 4, wherein:

said second means includes a peripherally extending rim portion and an intermediate portion disposed centrally within said peripherally extending rim portion, and wherein further said intermediate portion of said latch member has a C-shaped base section which is located between two sides of said peripherally extending rim portion so as to form elongated slots between two other sides of said rim portion and said intermediate portion, said C-shaped base section being defined by a flat member having said pawl means formed thereon and vertical wall members formed upon opposite sides of said pawl means and extending longitudinally between said elongated slots, said vertical wall members having at their uppermost extremities leg members, comprising said first means of said latch member and extending inwardly toward a central portion of said rim portion, formed thereon.

7. A fastener assembly as claimed in claim 6, wherein said vertical wall members and said inwardly extending leg members serve as a guide to enable the flanges of the track member to slide along the surfaces of the vertical wall members and leg members.

8. A fastener assembly as set forth in claim 6, wherein:

said peripheral extending rim portion has each one of said sides thereof sloped downwardly from an outermost portion of said rim portion toward said central portion of said rim portion.

9. A fastener assembly as claimed in claim 7, wherein said latch member is made of a resilient plastic material.

10. A fastener assembly as claimed in claim 9, wherein said elongated slots of the latch member are used to receive a garment cover strip which is sewn adjacent the ends of the track member so as to conceal the same.

11. A fastener assembly as set forth in claim 1, wherein:

said recesses have a substantially rectangular configuration.

12. A fastener assembly as set forth in claim 1, wherein:

said latch member is fabricated from a resilient plastic material.

13. A fastener assembly as set forth in claim 12, wherein:

said plastic material comprises a material selected from the group of polyethylene and polypropylene.

14. A fastener assembly as set forth in claim 1, wherein:

said pawl means includes an inclined portion for facilitating said selective engagement with said recesses of said track member as said latch member is moved relative to said track member in a first direction, and a vertical portion for preventing movement of said latch member relative to said track member in a second direction opposite to said first direction.

15. A fastener assembly as set forth in claim 1, wherein:

said clothing article band comprises a waistband.

16. A fastener assembly as set forth in claim 15, wherein:

said article of clothing comprises a pair of trousers.

17. A fastener assembly as set forth in claim 1, wherein:

said clothing article band comprises a headband.

18. A fastener assembly as set forth in claim 17, wherein:

said clothing article comprises a cap.

19. A fastener assembly as set forth in claim 17, further comprising:

slot means defined within said latch member for securing a strap of a clothing article within which said headband is disposed.

20. A fastener as set forth in claim 1, wherein:

said track member has a substantially T-shaped cross-sectional configuration; and said latch member has slot means, having a substantially T-shaped cross-sectional configuration, for accommodating said substantially T-shaped track member therewithin.

* * * * *